US005447259A

United States Patent [19]

Erickson

[11] Patent Number: 5,447,259

[45] Date of Patent: Sep. 5, 1995

[54] CONTAINER CARRIERS

[76] Inventor: Richard W. Erickson, 675 Brea Canyon Rd., #6, Walnut, Calif. 91789

[21] Appl. No.: 125,219

[22] Filed: Sep. 23, 1993

[51] Int. Cl.[6] ..... B65D 17/00

[52] U.S. Cl. ..... 220/759; 294/159; 294/170

[58] Field of Search ..... 220/759, 737, 743, 751, 220/159, 170; 294/145, 146, 158, 159, 167, 168, 170

[56] References Cited

U.S. PATENT DOCUMENTS

| | | | |
|---|---|---|---|
| 1,137,548 | 4/1915 | Spurrier | 294/146 |
| 1,137,909 | 5/1915 | Rusfeldt | 294/159 X |
| 1,377,931 | 5/1921 | Samuels | 215/100 A |
| 1,460,554 | 7/1923 | Moore | 220/759 X |
| 2,029,429 | 2/1936 | Koons | 294/145 X |
| 2,611,639 | 9/1952 | Sadeck | 220/759 X |
| 2,612,308 | 9/1952 | Potts | 294/170 X |
| 3,083,886 | 4/1963 | Fry | 294/159 |
| 3,251,622 | 5/1966 | Miller | 294/159 X |
| 5,181,757 | 1/1993 | Montoya | 294/159 X |
| 5,234,245 | 8/1993 | Peterson et al. | 294/158 |

FOREIGN PATENT DOCUMENTS

| | | | |
|---|---|---|---|
| 2541099 | 8/1984 | France | 294/170 |

*Primary Examiner*—Steven M. Pollard
*Attorney, Agent, or Firm*—Boniard I. Brown

[57] ABSTRACT

A carrier for a cluster of juxtaposed plastic jugs or other similar containers having handles by which the containers may be held. The carrier has a grip portion to be held in one hand and means on the grip portion engagable with the container handles for supporting the containers in suspended fashion from the carrier. A container package including a cluster of juxtaposed containers having handles and a carrier attached to the container handles including a grip to be held in one hand for carrying the container package.

10 Claims, 2 Drawing Sheets

CONTAINER CARRIERS

BACKGROUND OF THE INVENTION

FIELD OF THE INVENTION

This invention relates generally to container carriers and more particularly to an improved carrier for plastic jugs and other similar containers having handles by which the containers may be held.

REFERENCE TO RELATED COPENDING APPLICATIONS

Reference is made to my application Ser. No. 08/022,142, filed Feb. 25, 1993, now U.S. Pat. No. 5,346,271.

PRIOR ART

The improved container carrier of this invention is particularly useful for carrying plastic jugs and, for this reason, will be described in this context. It will become readily evident as the description proceeds, however, that the carrier may be used to carry other types of containers having handles. Plastic jugs of the kind with which this invention is concerned are widely used to package a great variety of consumer products for commercial sale. Among the more common of these products are beverages such as milk and water which are now commonly sold in plastic gallon jugs.

A typical plastic gallon jug has a generally rectangular plastic body and a plastic handle which are formed in one integral piece by a plastic molding process, such as a blow molding process. The jug body has normally upper and lower ends, a longitudinal axis extending between its ends, an upper coaxial neck closed by a removable cap, longitudinal corner edges, and lower relatively flat sides. The jug handle is located along one corner edge of the jug body in a plane containing the edge and the longitudinal axis of the jug. The handle has an upper end fixed to the jug body near the neck, a lower end fixed to the body below the upper handle end, and an intermediate grip portion. This handle grip portion is spaced from the jug body to form a handle opening between the body and the handle The jug is carried in a normal generally upright position by grasping the handle in one hand.

Filled jugs of this kind, that is, jugs filled with their particular consumer products, are marketed in many wholesale and retail outlets whose customers commonly purchase two or more jugs at a time. For this reason, it is desirable to package such jugs in pairs in order to permit two jugs to be easily held in one hand. My above mentioned copending application discloses a container carrier for holding a pair of jugs by one hand. The carrier of the copending application is designed to hold the jugs by their upper necks, not by their handles.

SUMMARY OF THE INVENTION

The present invention provides an improved carrier for containers having handles, and is designed to hold the containers by their handles. To this end, the improved carrier includes a grip portion by which the carrier may be held, and container handle engaging means for engaging the handles of a pair of juxtaposed containers in such a way as to support the containers on the carrier with the containers suspended from the carrier. The preferred handle engaging means are hooks over which the container handles are engagable. The carrier and containers supported on the carrier form a container package which can be carried in one hand by the carrier grip portion. When the container package is thus carried, the containers hang in suspended fashion from the carrier in a manner such that the containers are free to swing toward and into contact with one another.

The preferred container carrier described herein is particularly designed to carry two gallon plastic jugs of the kind discussed above. This preferred carrier is preferably molded in one piece from plastic and includes a flat central portion and flat end portions at opposite ends of the central portion. Each of these carrier portions has a normally upper edge. The central portion of the carrier has opposite sides and an opening through these sides whose upper edge is spaced from the upper edge of the central portion so as to form a carrier grip portion or handle along the upper edge of the central portion. The carrier end portions are joined to one and the same side of the carrier central portion and are disposed at equal oblique angles to the central portion and at an obtuse angle relative to one another. These end portions contain slots which open upwardly through the upper edges of the end portions to provide the end portions with hook-like shapes.

The preferred carrier is constructed and arranged for assembly on a pair of gallon plastic jugs which are juxtaposed side by side with their longitudinal axes in a common plane and their handles located opposite one another. When the carrier is assembled on the jugs, its central portion is situated between the common plane of the jug axes and the upper ends of the jug handles, and in a plane substantially parallel to the common plane of the jug axes. The carrier end portions extend through the handle openings of the jugs, substantially normal to the planes of the handles, and the upper ends of the jug handles engage in the carrier slots.

The slots in the end portions are preferably so sized in relation to the transverse size of the handles that the handles are resiliently compressed in a snap-past engagement, thus to retain the carrier on the jug handles when the carrier is not being held manually.

When the carrier is held by its grip portion or handle, the jugs hang in suspended fashion from the carrier end portions in such a way that the lower ends of the jugs are free to swing toward and into contact with one another.

While the container carrier of the invention is particularly adapted for use with plastic gallon jugs of the character described, the carrier may be used to carry any containers having handles capable of supporting engagement with the carrier handle engaging means.

DESCRIPTION OF THE PREFERRED EMBODIMENT

Figure 1:
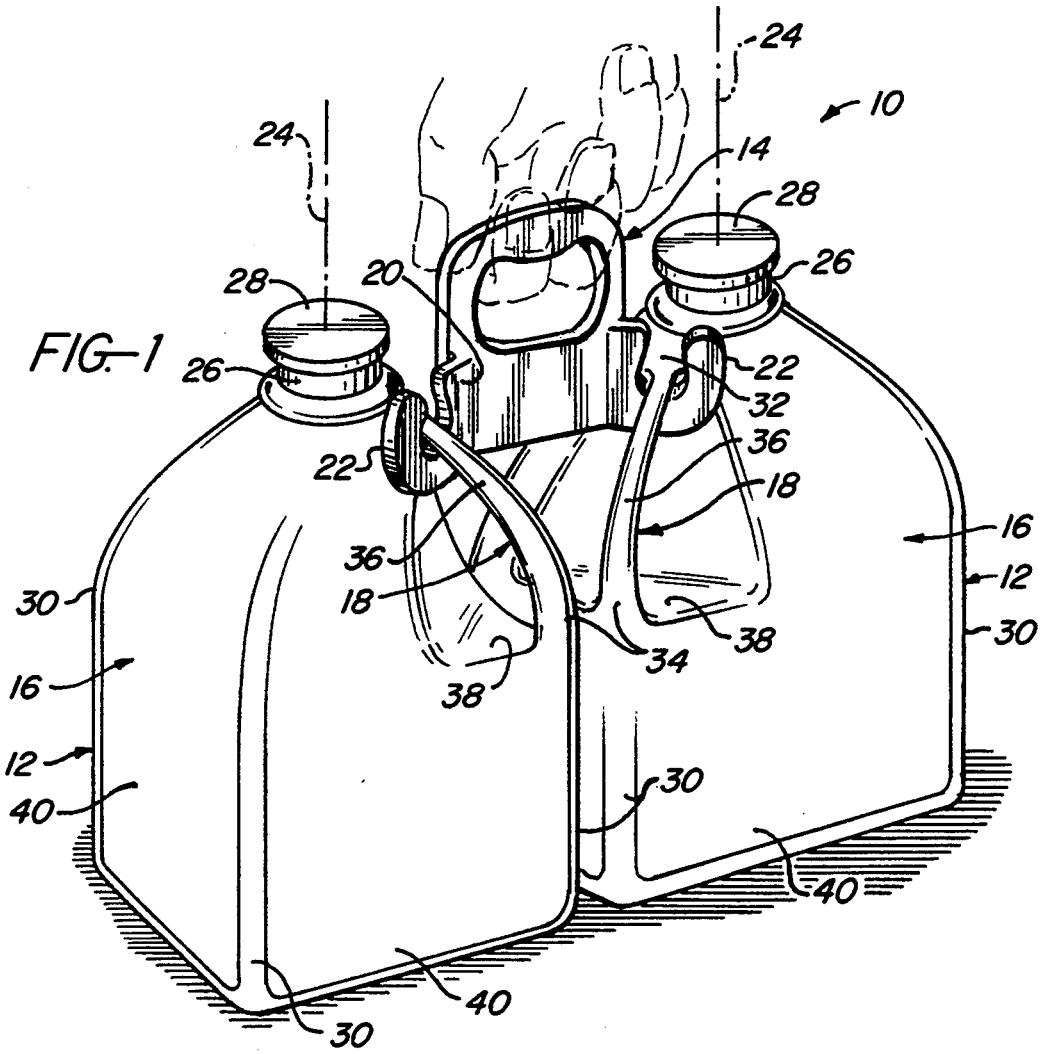
FIG. 1 is a perspective view of a container package according to this invention including an improved container carrier of the invention attached to a pair of containers, in this case plastic jugs.
Figure 2:
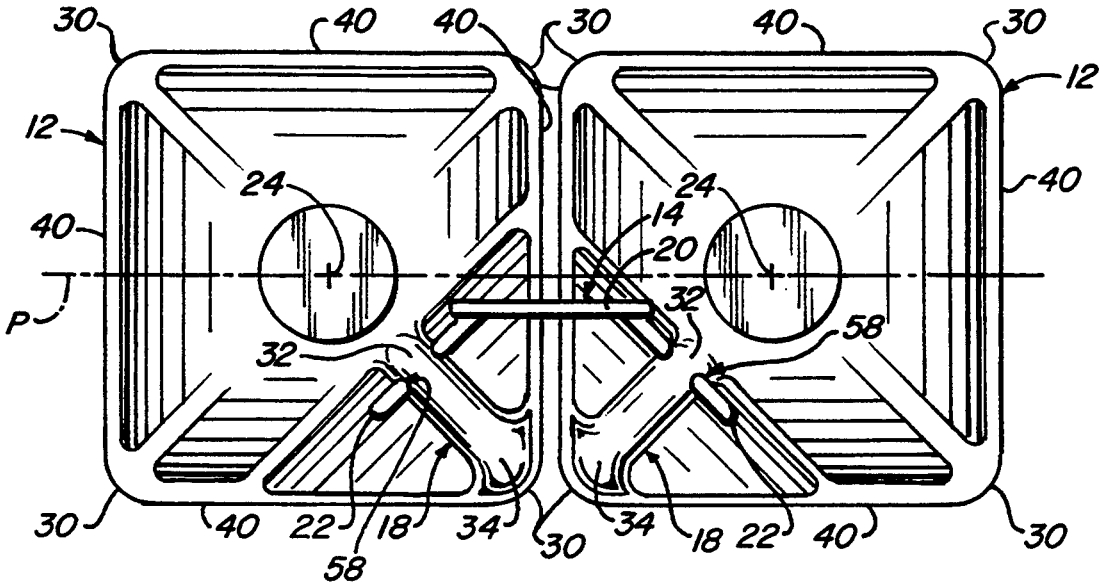
FIG. 2 is a top plan view of the container package in FIG. 1.

Referring now to these drawings, and first to FIGS. 1 and 2, there is illustrated a container package 10 according to the invention including a cluster of juxtaposed containers 12 and an improved container carrier 14 of the invention. The containers 12 are identical and each includes a container body 16 and a handle 18 by which the container may be carried by grasping the handle in one hand. The carrier 14 includes a central grip portion 20 by which the carrier may be held, and container handle engaging means 22 on the carrier grip portion engagable with the container handles 18 for supporting the containers on the carrier with the containers hanging in suspended fashion from the carrier. The preferred container handle engaging means 22 illustrated are essentially upwardly opening hooks situated at opposite ends of the carrier grip portion 20 for receiving the container handles 18.

The particular containers 12 illustrated are conventional gallon plastic jugs of the kind commonly used to market milk and water. The body 16 of each jug has normally upper and lower ends and a longitudinal axis 24 extending between these ends. An upper end portion of the body tapers inwardly and terminates in a reduced neck 26 through which the jug is initially filled and the contents of the jug are later dispensed. The open upper end of this neck is closed by a removable cap 28. The jug body 16 is generally rectangular in shape and has rounded longitudinal corner edges 30 which extend from the bottom of the jug to its upper neck 26.

The jug handle 18 is located at the upper end of the jug body 16 along one corner edge 30 of the body and in a plane containing this edge and the longitudinal axis 24 of the body. The handle has an upper end 32 fixed to the body adjacent its upper neck 26, a lower end 34 fixed to the body below the upper handle end, and an intermediate grip portion 36 between the handle ends. The portion of the jug body 16 over which the handle 18 extends is inwardly recessed so that the handle is spaced from the body to provide a handle opening 38 between the handle and the jug body. The lower portion of the jug body 16 between its bottom end and this body recess is rectangular (i.e., square) in cross-section in planes transverse to the jug axis 24,and has relatively flat sides 40.

Figure 5:
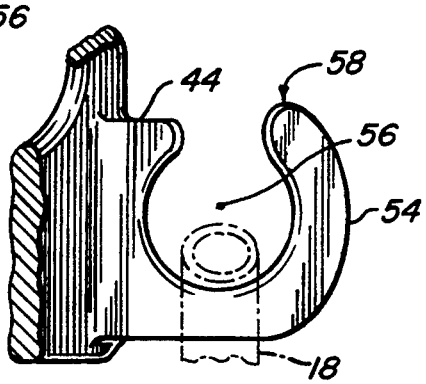
FIG. 5 is a view looking in the direction of the arrows on line 5—5 in FIG. 4.

The preferred container carrier 14 illustrated is uniquely constructed and arranged to carry the plastic jugs 12. As shown best in FIGS. 3–5, the carrier has an integral one-piece body which is preferably injection molded from a suitably strong plastic. The central grip portion 20 and end portions 22 of the carrier are relatively flat and have normally upper edges 42, 44 respectively. The central grip portion 20 has opposite flat sides 46 and a relatively large opening 48 through these sides. The upper edge 50 of the opening 48 is spaced a small distance from the upper edge 42 of the central portion 20 to form between these edges a carrier grip or handle 52. The edges 42, 50 are rounded, as shown, to provide a carrier grip or handle which is comfortable to hold.

Figure 3:
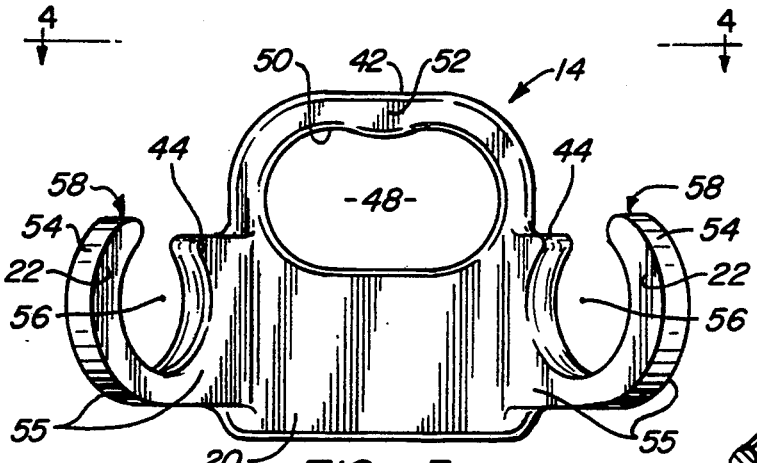
FIG. 3 is an enlarged side elevation of the container carrier in FIGS. 1 and 2.
Figure 4:
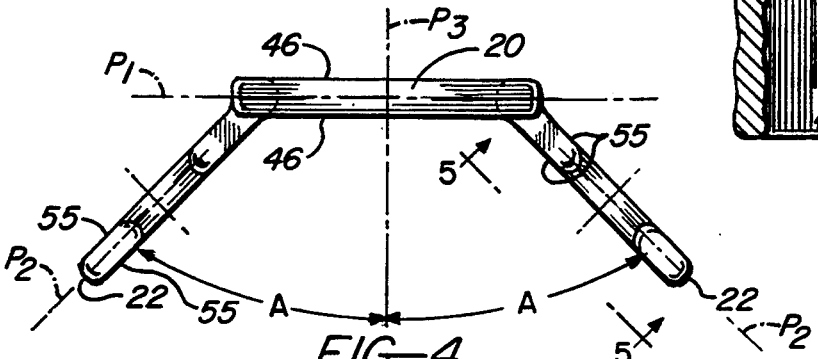
FIG. 4 is a top view of the carrier looking in the direction of the arrows on line 4—4 in FIG. 3.

As shown in FIGS. 3 and 4, the central grip portion 20 of the carrier is disposed in a plane P1 of the carrier normal to the plane of the paper in FIG. 4. The flat carrier end portions 22 are rigidly joined to the ends, respectively, of the central grip portion 20 and extend wing-like beyond one and the same side of the plane P1 of the central grip portion. These end portions are disposed in planes P2 normal to the plane of the paper in FIG. 4 which diverge outwardly from the central grip portion 20 at substantially equal acute angles A relative to a plane P3 normal to the plane of the paper in FIG. 4 passing through the central grip portion 20 transverse to the endwise direction or length thereof. The end portions have curved outer end edges 54, side faces 55 facing in opposite lateral directions of the planes P2 of the respective end portions, and key-hole shaped slots 56 which open upwardly through the upper edges 44 and laterally through the side faces 55 of the respective end portions to form upwardly opening hooks 58 disposed in the planes P2. The side 46 of the central grip portion 20 at which the hooks 58 are located is hereafter referred to as the hook side of the grip portion.

Figure 6:
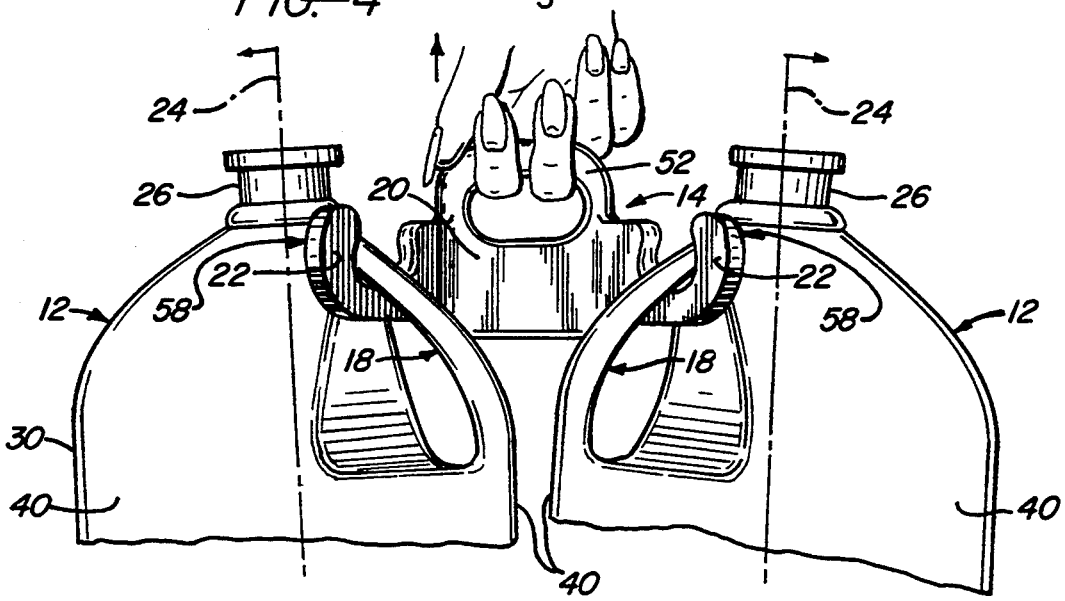
FIG. 6 is a fragmentary side view of the container package of FIG. 1 illustrating the manner in which the carried containers are free to swing toward and into contact with one another when the package is carried.

The carrier 14 is constructed and arranged to hold and carry a cluster of two plastic jugs 12 situated side by side with their longitudinal axes 24 located in a common plane P (FIG. 2), with flat sides 40 of the jugs disposed face to face, and with the jug handles 18 located opposite one another in the manner shown in FIGS. 1, 2 and 6. The carrier is placed on the containers in the position of FIGS. 1, 2, 6. In this position, the central grip portion 20 of the carrier parallels the common plane P of the jug axes 24 and is located between this plane and the upper ends 32 of the jug handles 18 with the hook side of the grip portion facing the upper ends 32 of the jug handles. The carrier hooks 58 extend through the handle openings 38 of the jugs 12, generally normal to the planes of the jug handles 18. Accordingly, the hook planes P2 in FIG. 4 are disposed at 45 degree angles relative to both the plane P1 of the central grip portion 20 and the plane P3 transverse to the endwise direction or length of the grip portion. The hooks engage the handles in such a way that the upper handle ends 32 seat within the hook slots 56. The carrier is assembled on the jugs 12 in this way by placing the carrier over the jugs in the position of the carrier in FIG. 2, then pushing the carrier downwardly until the carrier hooks 58 enter the jug handle openings 38, and pulling up on the carrier to engage the upper handle ends 32 in the hook slots 56. The hook slots are so sized and configurated in relation to the transverse size of the handles, that the handles are resiliently compressed in a snap-past action or engagement, upon being received in the slots. This relative sizing insures that the carrier is retained on the handles when the carrier is not manually gripped and supported.

The container package 10 is held by the carrier grip or handle 52 in the manner shown in FIG. 6. When the package is thus held, the jugs 12 hang in suspended fashion from the carrier. The jugs are freely swingable on the carrier hooks 58. Because the jugs are thus freely swingable, and because the upper ends 32 of the jug handles 18 are offset from the centers of gravity of the jugs, the jugs swing toward and into contact with one another, as illustrated in FIG. 6. It is apparent at this point that while the illustrated carrier is particularly designed for use with plastic jugs of the kind illustrated, the carrier may be used to carry other types of containers having handles capable of supporting engagement with the carrier hooks.

I claim:

1. A carrier for jugs each having normally upper and lower ends and including a body having a normally upper neck, a generally rectangular portion below said neck having corners extending from the lower end of the jug to said neck, and a carrying handle along one corner having an upper end secured to said body adjacent said neck and a lower end secured to said body below said upper handle end, said carrier comprising:

a rigid one piece carrier member capable of being molded and including a central planar grip portion having opposite ends and disposed in a certain plane of said member, and planar hooks rigidly joined to said ends, respectively, of said central grip portion and extending beyond one and the same side of said certain plane in second planes, respectively, which diverge at substantially equal acute angles relative to a common third plane transverse to the endwise direction of said central grip portion, and wherein said central grip portion comprises an elongate hand grip extending endwise of said central portion for holding said carrier in a normal carrying position, and each hook has opposite sides facing in opposite lateral directions of said second plane of the respective hook, an edge between said opposite sides which forms an upper edge of the respective hook when said carrier occupies said normal carrying position, and a slot opening laterally through said opposite sides and upwardly through said upper edge of the respective hook for receiving a jug handle.

2. A carrier according to claim 1 wherein:

said central grip portion has opposite sides facing in opposite lateral directions of said certain plane and an opening adjacent said upper edge of said central grip portion forming said hand grip between said opening and said upper edge of said central grip portion, and said upper edges of said hooks are located below the level of said hand grip when said carrier occupies said normal carrying position.

3. A carrier according to claim 1 wherein:

said central grip portion and said hooks are relatively flat.

4. A carrier according to claim 1 wherein:

said equal acute angles between said second and third planes are approximately 45 degree angles.

5. A carrier according to claim 1 wherein:

said central grip portion and said end portions are relatively flat, said central grip portion has opposite sides facing in opposite lateral directions of said certain plane an opening through said sides and adjacent said upper edge of said central grip portion and forming said hand grip between said opening and said upper edge of said central grip portion, said upper edges of said hooks are located below the level of said hand grip when said carrier occupies said normal carrying position, and said equal acute angles between said second and third planes are approximately 45 degree angles.

6. A container package comprising:

a pair of jugs each having normally upper and lower ends and including a body having a normally upper neck, a generally rectangular portion below said neck having corners extending from the lower end of the jug to said neck, and a carrying handle along one corner between two adjacent sides of said body having an upper end secured to said body adjacent said neck and a lower end secured to said body below said upper handle end and spaced from said body between said handle ends to form a handle opening between said body and said handle, said jugs being disposed side by side with one of said sides of one jug body facing and disposed in close proximity to the other of said sides of the other jug body to locate said handles adjacent one another, a carrier for carrying said jugs comprising a rigid one piece carrier member capable of being molded and including a central planar grip portion having opposite ends and disposed in a certain plane of said member, and planar hooks rigidly joined to said ends, respectively, of said central grip portion and extending beyond one and the same side of said certain plane in second planes, respectively, which diverge at substantially equal acute angles relative to a common third plane transverse to the endwise direction of said central grip portion, and wherein said central grip portion comprises an elongate hand grip extending endwise of said central portion for holding said carrier in a normal carrying position, each hook has opposite sides facing in opposite lateral directions of said second plane of the respective hook, an edge between said opposite sides which forms an upper edge of the respective hook when said carrier occupies said normal carrying position, and a slot opening laterally through said opposite sides and upwardly through said upper edge of the respective hook, and said carrier is disposed between the upper ends of said jugs with said grip portion extending endwise between the jugs, with said hooks extending through said handle openings of the jugs, and with the jug handles disposed in said hook slots to permit said container package to be held in a normal carrying position by said hand grip.

7. A container package according to claim 6 wherein:

said carrier central grip portion has opposite sides facing in opposite lateral directions of said certain carrier plane and an opening adjacent said upper edge of said central grip portion forming said hand grip between said opening and said upper edge of said central grip portion, and said upper edges of said hooks are located below the level of said hand grip in said normal carrying position.

8. A container according to claim 29 wherein:

said central grip portion and said hooks are relatively flat.

9. A container package according to claim 6 wherein:

said equal acute angles between said second and third planes are approximately 45 degree angles.

10. A container package according to claim 6 wherein:

said central grip portion and said end portions are relatively flat, said central grip portion has opposite sides facing in opposite lateral directions of said certain plane an opening through said sides and adjacent said upper edge of said central grip portion and forming said hand grip between said opening and said upper edge of said central grip portion, said upper edges of said hooks are located below the level of said hand grip when said carrier occupies said normal carrying position, and said equal acute angles between said second and third planes are approximately 45 degree angles.

* * * * *